United States Patent [19]

Nishikawa

[11] 4,093,368

[45] June 6, 1978

[54] ELECTROGRAPHIC APPARATUS

[75] Inventor: Masaji Nishikawa, Hachioji, Japan

[73] Assignee: Olympus Optical Company Limited, Tokyo, Japan

[21] Appl. No.: 744,267

[22] Filed: Nov. 23, 1976

[30] Foreign Application Priority Data

Nov. 27, 1975 Japan ..... 50-141114

[51] Int. Cl.[2] ..... G03G 15/00

[52] U.S. Cl. ..... 355/3 SC; 355/3 R; 355/15

[58] Field of Search ..... 355/3 R, 15, 3 SC, 3 TE; 15/1.5; 98/1

[56] References Cited

U.S. PATENT DOCUMENTS

| | | | |
|---|---|---|---|
| T940,022 | 11/1975 | Rodda | 355/3 R |
| 3,635,555 | 1/1972 | Kurahashi | 355/3 R X |
| 3,914,046 | 10/1975 | Tanaka et al. | 355/15 |
| 3,936,184 | 2/1976 | Tanaka et al. | 355/15 |

FOREIGN PATENT DOCUMENTS

| | | | |
|---|---|---|---|
| 2,302,302 | 7/1973 | Germany | 355/15 |

*Primary Examiner*—Richard L. Moses
*Attorney, Agent, or Firm*—Haseltine, Lake & Waters

[57] ABSTRACT

An electrographic apparatus comprising a drum type screen photosensitive body and for producing, on a record sheet having a dielectric material layer, an electrostatic charge image corresponding to an image to be recorded in response to an electrostatic latent image formed on the screen photosensitive body by controlling a flow of ions directed from a corona discharge device through the screen photosensitive body toward the record sheet is disclosed. The apparatus comprises a casing for substantially hermetically surrounding said drum type screen photosensitive body and an air circulating device for circulating a flow of air through said casing.

6 Claims, 4 Drawing Figures

ELECTROGRAPHIC APPARATUS

Figure 1:
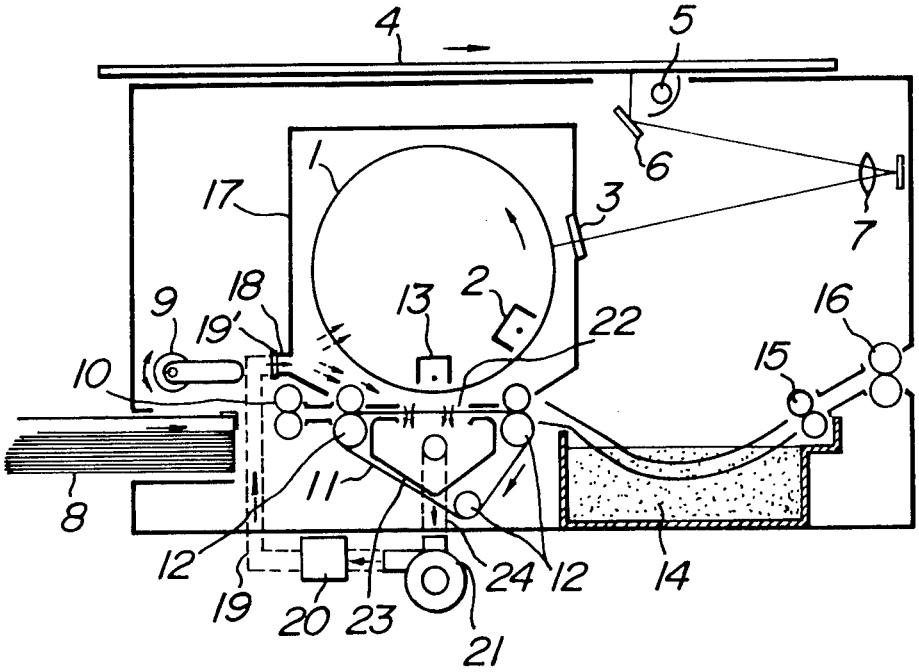

This invention relates to an electrographic apparatus comprising a drum type screen photosensitive body and for producing, on a record sheet having a dielectric material layer, an electrostatic charge image corresponding to an image to be recorded in response to an electrostatic latent image formed on the screen photosensitive body by controlling a flow of ions directed from a corona discharge device toward the record sheet.

Various types of such electrographic apparatuses have heretofore been well known. One of problems which has been encountered with practicing such electrographic apparatus consists in that the photosensitive screen becomes covered with minute dust and hence subjected to water content in air, and as a result, the surface resistance and charge potential of a photosensitive layer are decreased thus considerably increasing dark attenuation and rendering it impossible to obtain a satisfactory record.

Attempts have heretofore been made to solve such problem by means of the following two means.

(1) The open air is purified by a dust collector and the air thus purified is introduced into the electrographic apparatus. In addition, a high internal pressure is applied in the electrographic apparatus to prevent dust in the open air from being penetrated into the electrographic apparatus.

(2) Dust adhered to the screen is removed mechanically or electrostatically.

The first means, however, has a number of disadvantages. In the first place, even though dust is removed in the step of introducing the open air into the electrographic apparatus, a rate of removing dust is about 90% with the aid of an electric dust collector. Secondly, if use is made of a dust filter, it is difficult to remove minute dust having a diameter of smaller than 1 $\mu$. Third, if the open air is continuously introduced into the electrographic apparatus, the amount of minute dust remained becomes so large that the presence thereof can not be disregarded. Fourth, if the open air introduced into the electrographic apparatus is made so large as to raise the internal pressure therein, a rate of preventing dust from being penetrated by making the internal pressure high becomes so small if compared with a rate of remaining dust in the purified air that the introduction of large amount of the open air into the electrographic apparatus is detrimental thereto. Fifth, various corona discharge devices provided in the electrographic apparatus function to collect the dust remained therein and the screen functions also as a dust collecting electrode, and as a result, most of dusts are adhered to the screen. Finally, such dust collecting means is troublesome in maintenance.

The second dust removing means for mechanically or electrostatically removing dust which has been adhered to the screen has the disadvantage that it is complex and delicate in construction and liable to be easily broken, that the screen is required to be touched, and that in the case of electrostatically removing dust it is required to apply a relatively high electric field to the screen such that a spark discharge is not occurred, and that it is very difficult to remove dust adhered to the inside of the screen meshes.

An object of the invention, therefore, is to provide an electrographic apparatus which is simple and less expensive in construction and can obviate the above mentioned disadvantages, which can effectively prevent the screen from being adhered with dust and which can prevent breakage of the screen in a simple and less expensive manner.

A feature of the invention is the provision of an electrographic apparatus comprising a drum type screen photosensitive body and for producing, on a record sheet having a dielectric material layer, an electrostatic charge image corresponding to an image to be recorded by controlling a flow of ions directed from a corona discharge device through the screen photosensitive body toward the record sheet, said apparatus comprising a casing for substantially hermetically surrounding said drum type screen photosensitive body and an air circulating device for circulating a flow of air through said casing.

The electrographic apparatus according to the invention makes use of a casing for substantially hermetically surrounding a photosensitive screen and causes the flow of air to circulate in the casing, so that the amount of dust adhered to the screen is limited to an amount of dust contained in the flow of air circulated in the casing. As a result, the amount of dust introduced into the electrographic apparatus becomes extremely small if compared with the conventional means for introducing the open air into the electrographic apparatus. For this purpose, it is required to arrange a suction air portion and an exhaust portion of circulating air as near as possible so as to prevent the circulating air from being easily mixed with any other air.

Another feature of the invention is the provision of an electrographic apparatus comprising an exhaust opening provided in the casing and located at such position that the exhaust opening is closed by the record sheet having the dielectric material layer and a suction means for subjecting a suction force to the record sheet having the dielectric material layer so as to hold it at a given position. The use of such suction means provides the advantage that a distance between the record sheet having the dielectric material layer and the screen can always be held to a given value, and as a result, a good electrostatic charge image corresponding to an image to be recorded can be produced on the record sheet having the dielectric material layer.

A further feature of the invention is the provision of an electrographic apparatus comprising at least one electric dust collector arranged in an air circulating path so as to remove dust contained in a flow of circulating air.

A still further feature of the invention is the provision of an electrographic apparatus comprising a filter formed of an ozone decomposition substance and arranged in an air circulating path so as to obviate bad influence of ozone upon a screen photosensitive body, the ozone being produced from a corona discharge device. It is preferable to use such filter formed of the ozone decomposition substance in combination with the above mentioned electric dust collector. This is because of the fact that the filter also functions to decompose ozone produced from the electric dust collector.

Figure 2A:
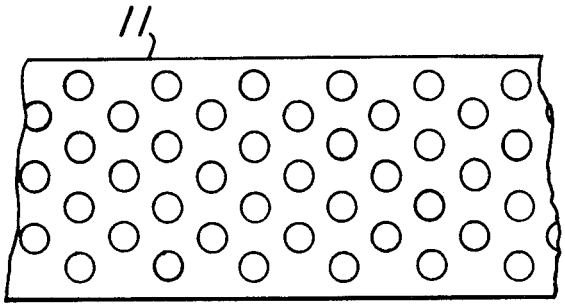
Figure 2B:
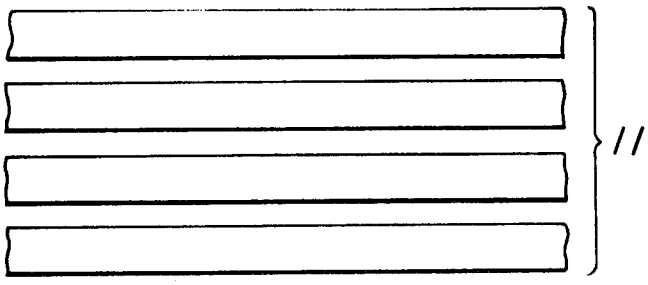
Figure 3:
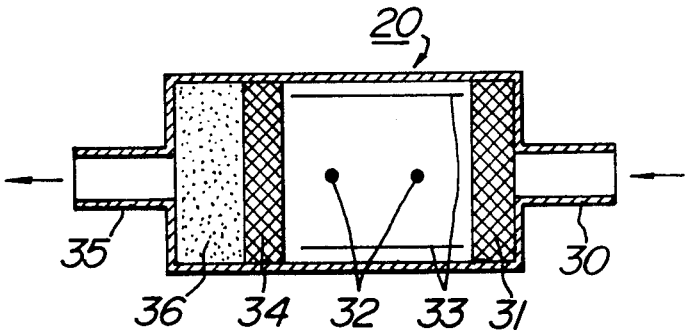

The invention will now be described in greater detail with reference to the accompanying drawings, wherein:

FIG. 1 is a diagram schematically illustrating one embodiment of an electrograpic apparatus according to the invention;

FIG. 2*a* is a plan view showing one embodiment of a record sheet feeding belt provided in the electrographic apparatus according to the invention;

FIG. 2*b* is a plan view showing a modified embodiment of the record sheet feeding belt shown in FIG. 2*a*; and FIG. 3 is a cross-sectional view showing one embodiment of a dust collector provided in the electrographic apparatus according to the invention.

Referring to one embodiment of the electrographic apparatus showing in FIG. 1, a photosensitive screen drum 1 is rotated by a suitable driving mechanism (not shown) at a constant speed in a direction shown by an arrow. At first, the screen drum 1 is uniformly charged by a first corona discharge device 2 and then arrives at a light transmitting window 3. A manuscript (not shown) disposed on a manuscript shifting table 4 is illuminated with light radiated from a lamp 5. The light reflected from the manuscript is projected through a reflecting mirror 6, inmirror lens 7 and the light transmitting window 3 on the screen drum 1. As a result, the uniform charge on the screen drum 1 becomes changed in response to a light image projected thereon to form an electrostatic latent image. The screen drum 1 continues its rotation. A paper supply roller 9 causes a record sheet having a dielectric material layer to be fed one by one from a paper cassette 8 and then is fed by feeding rollers 10. The record sheet having the dielectric material layer is then fed at a constant speed by means of an endless conveyor belt 11 which is adapted to be driven by three driving rollers 12. The screen drum 1 is rotating with the record sheet having the dielectric material layer spaced apart by a constant distance. In this case, a flow of ions is directed from a second corona discharge device 13 through meshes of the screen drum 1 toward the record sheet having the dielectric material layer. This flow of ions is controlled by the electrostatic latent image formed on the screen drum 1 to produce an electrostatic charge image corresponding to an image to be recorded in response to the electrostatic latent image. The record sheet having the dielectric material layer is then fed to a developing device 14 where it is developed and subsequently supplied to squeezing rollers 15 and absorbing rollers 16 by which surplus developing liquid is removed and finally dried. A copy thus dried is delivered to the outside of the electrographic apparatus. The screen drum 1 while rotating repeats the above mentioned operation.

In accordance with the invention, provision is made of a casing 17 adapted to substantially hermetically surround the screen drum 1. The casing 17 is provided at its one portion with an air inlet opening 18 to which is connected a pipe 19. The other end of the pipe 19 is connected through a dust collector 20 to an air outlet opening of an air supply fan 21. The pipe is provided near at the air inlet opening 18 with a filter 19' formed of sponge or glass wool. The casing 22 is provided at its bottom wall with an opening 22 through which a flow of ions is passed from the corona discharge device 13 toward the record sheet having the dielectric material layer. Below the endless conveyor belt 11 is arranged a suction box 23 which is connected through a pipe 24 to an air suction opening of te air supply fan 21.

Air supplied from the air supply fan 21 is fed to the dust collector 20 where dust contained in the air is collected and removed. The air is then is supplied through the pipe 19 and the air inlet opening 18 into the casing 17. A part of the flow of air introduced into the casing 17 is penetrated through the meshes of the screen drum 1 therein and then discharged through the meshes of the screen drum 1 therefrom. This flow of air functions not only to remove dust adhered to the screen drum 1, but also to remove ozone produced from the first and second corona discharge devices 2, 13. It is preferable that each of the corona discharge devices 2, 13 is provided at its housing with openings for passing ozone produced therefrom.

The flow of air containing dust and ozone therein is sucked through the opening 22 of the casing 17 into the suction box 23. In order to make such flow of air freely pass through the conveyor belt 11, the conveyor belt 11 is provided with a number of holes as shown in FIG. 2*a* or is formed of a number of bands as shown in FIG. 2*b*.

The flow of air sucked into the suction box 23 is supplied through the pipe 24 to the air supply fan 21. In this way, the flow of air is forcedly circulated through the casing 17 to remove dust adhered to the screen drum 1. The dust thus removed is collected into the dust collector 20 provided in the air circulating path.

The suction box 23 arranged below the conveyor belt 11 causes the record sheet disposed on the conveyor belt 11 to be subjected to suction force, and as a result, the record sheet is firmly secured to the conveyor belt 11 thereby maintaining a predetermined distance between the record sheet 1 and the screen drum 1.

In FIG. 3 is shown one embodiment of the dust collector 20 shown in FIG. 1. In the present embodiment, the dust collector 20 is provided near at its air inlet opening 30 with a first filter 31 and incorporated in the rear of the first filter 31 with an electric dust collector composed of corona discharge electrodes 32 and dust collecting electrodes 33. In addition, the dust collector 20 is provided in the rear of the electric dust collector with a second filter 34. Between the second filter 34 and an exhaust opening 35 is arranged a third filter 36 formed of ozone decomposition substance.

The dust collector 20 constructed as above described will operate as follows. In the first place, the first filter 31 functions to remove bulky dust from the flow of air introduced therein. Secondly, the electric dust collector 32, 33 functions to remove minute dust from the flow of air passing therethrough. Third, the second filter 34 functions to collect dust eventually dropped from the dust collecting electrodes 33. Finally, the third filter 36 formed of the ozone decomposition substance functions to decompose and remove ozone contained in the flow of air passing therethrough. A combination of the electric dust collector 32, 33 and the first and second filters 31, 34 arranged in front of and in the rear of the electric dust collector 32, 33 makes it possible to make the dust collector 20 long in life and cause the second filter 34 to collect dust eventually dropped from the dust collecting electrodes 33 in an easy manner.

The invention is not limited to the above described embodiments and many alternations and modifications are possible. For example, the flow of air may be exhausted from the casing 17 through any parts other than the opening 22 provided in the base plate of the casing 17, for example, through an end portion of the screen drum 1. In addition, use may be made of various types of dust collectors other than the above mentioned embodiment of the dust collector 20.

What is claimed is:

1. In an electrographic apparatus comprising a drum type screen photosensitive body and for producing, on a record medium having a dielectric material layer, an electrostatic charge image corresponding to an image to be recorded in response to an electrostatic latent image formed on the screen photosensitive body by controlling a flow of corona ions directed from a corona discharge device through said screen photosensitive body toward the record medium, the improvement comprising: a casing for substantially hermetically surrounding said drum type screen photosensitive body, an air circulating device for circulating a flow of air through said casing, an air circulating path extending from said casing to said air circulating device, and suction means disposed in said air circulating path to secure said record medium firmly in position thereby maintaining a predetermined distance between said record medium and said screen photosensitive body.

2. An electrographic apparatus as claimed in claim 1, wherein: filter means are arranged in said air circulating path.

3. An electrographic apparatus as claimed in claim 1, wherein: at least one electric dust collector means are arranged in said air circulating path.

4. An electrographic apparatus as claimed in claim 1, wherein: said apparatus being formed with at least one filter formed of an ozone decomposition substance for decomposing ozone produced from said corona discharge device.

5. An electrographic apparatus as claimed in claim 2, wherein: said filter means are formed of sponge.

6. An electrographic apparatus as claimed in claim 2, wherein: said filter means are formed of glass wool.

* * * * *